US008777663B2

(12) United States Patent
Annis et al.

(10) Patent No.: US 8,777,663 B2
(45) Date of Patent: Jul. 15, 2014

(54) RECEPTACLE ASSEMBLY HAVING A COMMONING CLIP WITH GROUNDING BEAMS

(71) Applicant: Tyco Electronics Corporation, Berwyn, PA (US)

(72) Inventors: Kyle Gary Annis, Hummelstown, PA (US); Robert Neil Whiteman, Jr., Middletown, PA (US); Wayne Samuel Davis, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 53 days.

(21) Appl. No.: 13/685,449

(22) Filed: Nov. 26, 2012

(65) Prior Publication Data

US 2014/0148054 A1 May 29, 2014

(51) Int. Cl.
*H01R 13/648* (2006.01)

(52) U.S. Cl.
USPC ..... 439/607.05

(58) Field of Classification Search
CPC ..... H01R 13/514; H01R 13/518; H01R 13/65807; H01R 23/688; H01R 123/725; H01R 23/7073
See application file for complete search history.

(56) References Cited

U.S. PATENT DOCUMENTS

| | | | | |
|---|---|---|---|---|
| 6,905,368 | B2 * | 6/2005 | Mashiyama et al. | 439/607.08 |
| 7,976,340 | B1 | 7/2011 | Sarawat et al. | |
| 8,157,591 | B2 | 4/2012 | Fedder et al. | |
| 8,157,595 | B2 | 4/2012 | Sarawat et al. | |
| 8,187,035 | B2 * | 5/2012 | Davis et al. | 439/607.02 |
| 8,221,139 | B2 | 7/2012 | Qin et al. | |
| 8,262,412 | B1 | 9/2012 | Minnick et al. | |
| 8,398,432 | B1 * | 3/2013 | McClellan et al. | 439/607.07 |
| 8,419,472 | B1 * | 4/2013 | Swanger et al. | 439/607.07 |
| 8,500,487 | B2 * | 8/2013 | Morgan et al. | 439/607.06 |
| 8,579,636 | B2 * | 11/2013 | Davis et al. | 439/65 |
| 2004/0092140 | A1 * | 5/2004 | Mashiyama et al. | 439/83 |
| 2011/0294346 | A1 * | 12/2011 | Davis et al. | 439/607.01 |

FOREIGN PATENT DOCUMENTS

| | | | |
|---|---|---|---|
| EP | 2390961 | A1 | 11/2011 |
| WO | 00/10233 | A2 | 2/2000 |

OTHER PUBLICATIONS

European Search Report issued in related application No. EP 13194479.5 mailed on Feb. 12, 2014.

* cited by examiner

*Primary Examiner* — Chandrika Prasad

(57) ABSTRACT

A receptacle assembly includes a front housing configured for mating with a header assembly. A plurality of contact modules are coupled to the front housing. Each contact module includes right and left conductive shells. Each conductive shell holds a frame assembly including a plurality of contacts that extend from the conductive shell for electrical termination. A commoning clip is coupled to the plurality of contact modules. The commoning clip has grounding beams extending forward of the right and left conductive shells for electrical connection to header shields of the header assembly. The commoning clip includes a plurality of openings in a rear thereof with barbs along sides of the openings. Each opening receives right and left conductive shells of a corresponding contact module with the barbs engaging the right and left shells to electrically connect the commoning clip to both the right and left shells of each contact module.

20 Claims, 9 Drawing Sheets

RECEPTACLE ASSEMBLY HAVING A COMMONING CLIP WITH GROUNDING BEAMS

BACKGROUND OF THE INVENTION

The subject matter herein relates generally to grounding connector assemblies.

Some electrical systems utilize electrical connectors to interconnect two circuit boards, such as a motherboard and daughtercard. In some systems, to electrically connect the electrical connectors, a midplane circuit board is provided with front and rear header connectors on opposed front and rear sides of the midplane circuit board. Other systems electrically connect the circuit boards without the use of a midplane circuit board by directly connecting electrical connectors on the circuit boards.

However, as speed and performance demands increase, known electrical connectors are proving to be insufficient. Signal loss and/or signal degradation is a problem in known electrical systems. Additionally, there is a desire to increase the density of electrical connectors to increase throughput of the electrical system, without an appreciable increase in size of the electrical connectors, and in some cases, with a decrease in size of the electrical connectors. Some known connector systems increase density by coupling multiple contact modules side by side within a single receptacle assembly. Such increase in density and/or reduction in size causes further strains on performance.

In order to address performance, some known systems utilize shielding to reduce interference between the contacts of the electrical connectors. However, the shielding utilized in known systems is not without disadvantages. For instance, electrically connecting the grounded components of the two electrical connectors at the mating interface of the electrical connectors is difficult and defines an area where signal degradation occurs due to improper shielding at the interface. For example, some known systems include ground shields on both sides of the contact modules that connect to corresponding header shields of the mating connector. However, conventional electrical connectors have poor connections between the ground shields and the conductive holder and/or between the conductive holders of the contact module that provides shielding around the contacts. Additionally, the contact modules are typically made from two halves coupled together. The ground shields, when making connection to the header shields, may tend to force the two halves apart, which is problematic.

A need remains for an electrical system that provides efficient shielding to meet particular performance demands. A need remains for an electrical system that provides structural support to contact modules of a receptacle assembly.

BRIEF DESCRIPTION OF THE INVENTION

In one embodiment, a receptacle assembly is provided having a front housing configured for mating with a header assembly. A plurality of contact modules are coupled to the front housing. The contact modules each include a right sub-assembly and a left sub-assembly. The right sub-assembly includes a right conductive shell that holds a frame assembly. The frame assembly has a plurality of contacts and a dielectric frame supporting the contacts. The dielectric frame is received in the right conductive shell, and the contacts extend from the right conductive shell for electrical termination. The left sub-assembly includes a left conductive shell that holds a frame assembly. The frame assembly has a plurality of contacts and a dielectric frame supporting the contacts. The dielectric frame is received in the left conductive shell, and the contacts extend from the left conductive shell for electrical termination. A commoning clip is coupled to the plurality of contact modules. The commoning clip has grounding beams extending from a front thereof. The grounding beams extend forward of the right and left conductive shells for electrical connection to header shields of the header assembly. The commoning clip includes a plurality of openings in a rear thereof with barbs along sides of the openings. Each opening receives right and left conductive shells of a corresponding contact module with the barbs engaging the right and left conductive shells to electrically connect the commoning clip to both the right and left conductive shells of each contact module.

In another embodiment, a receptacle assembly is provided having a front housing configured for mating with a header assembly. A plurality of contact modules are coupled to the front housing. The contact modules each include a right sub-assembly and a left sub-assembly. The right sub-assembly includes a right conductive shell that holds a frame assembly. The frame assembly has a plurality of contacts and a dielectric frame supporting the contacts. The dielectric frame is received in the right conductive shell, and the contacts extend from the right conductive shell for electrical termination. The left sub-assembly includes a left conductive shell that holds a frame assembly. The frame assembly has a plurality of contacts and a dielectric frame supporting the contacts. The dielectric frame is received in the left conductive shell, and the contacts extend from the left conductive shell for electrical termination. A right ground shield is coupled to the right conductive shell. The right ground shield has grounding fingers extending from a front of the right ground shield. The grounding fingers extend forward of the front of the right ground shield for electrical connection to header shields of the header assembly. A left ground shield is coupled to the left conductive shell. The left ground shield has grounding fingers extending from a front of the left ground shield. The grounding fingers extend forward of the front of the left ground shield for electrical connection to header shields of the header assembly. A commoning clip is coupled to the plurality of contact modules. The commoning clip has grounding beams extending from a front thereof. The grounding beams extend forward of the right and left conductive shells for electrical connection to the header shields of the header assembly. The commoning clip is directly electrically connected to the right and left conductive shells of each contact module to electrically connect the commoning clip to each contact module. The commoning clip is directly electrically connected to the right and left ground shields of each contact module to electrically connect the commoning clip to each contact module.

DETAILED DESCRIPTION OF THE INVENTION

Figure 1:
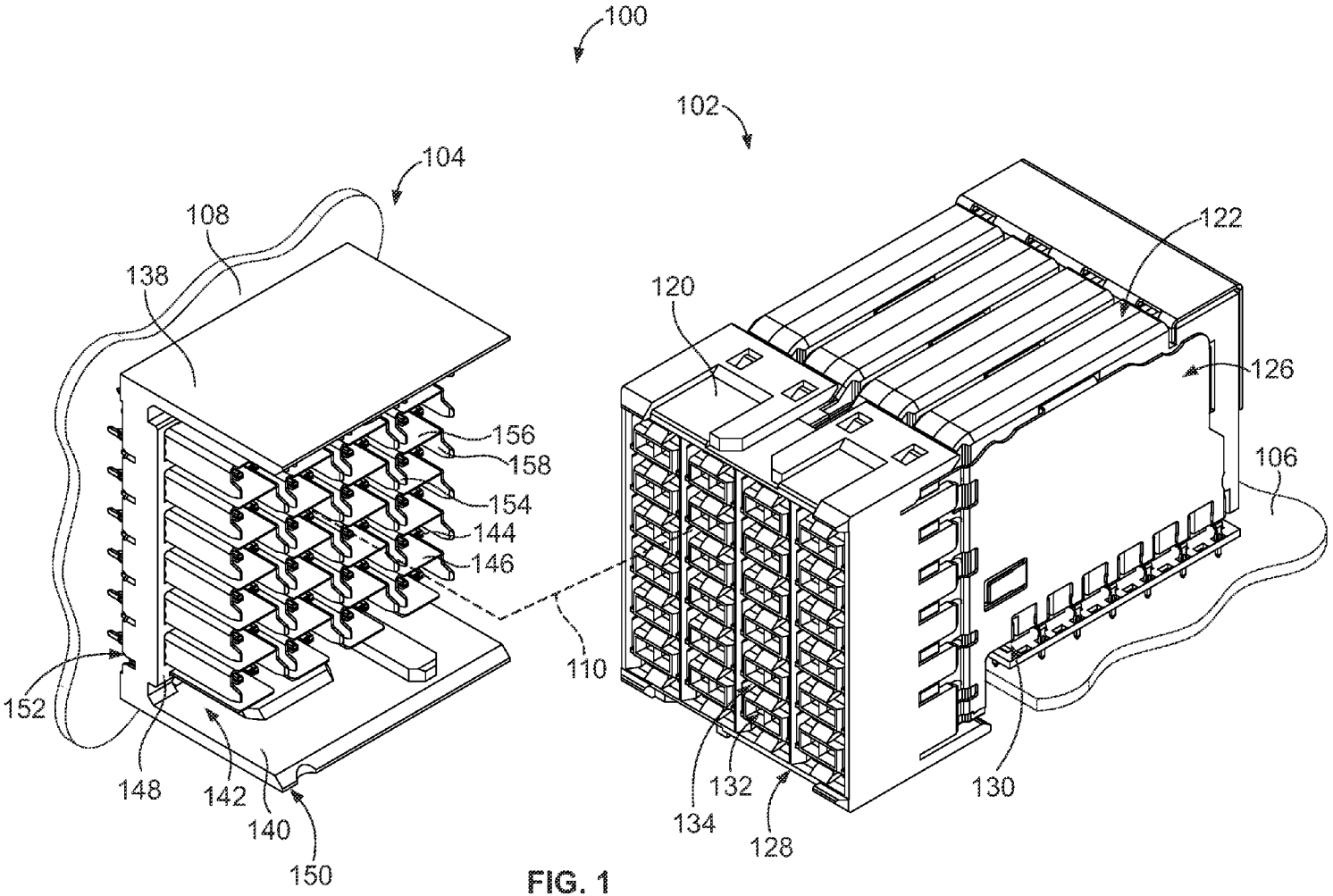
FIG. 1 is a perspective view of an exemplary embodiment of an electrical connector system illustrating a receptacle assembly and a header assembly.

FIG. 1 is a perspective view of an exemplary embodiment of an electrical connector system 100 illustrating a receptacle assembly 102 and a header assembly 104 that may be directly mated together. The receptacle assembly 102 and/or the header assembly 104 may be referred to hereinafter individually as a "connector assembly" or collectively as "connector assemblies". The receptacle and header assemblies 102, 104 are each electrically connected to respective circuit boards 106, 108. The receptacle and header assemblies 102, 104 are utilized to electrically connect the circuit boards 106, 108 to one another at a separable mating interface. In an exemplary embodiment, the circuit boards 106, 108 are oriented perpendicular to one another when the receptacle and header assemblies 102, 104 are mated. Alternative orientations of the circuit boards 106, 108 are possible in alternative embodiments.

A mating axis 110 extends through the receptacle and header assemblies 102, 104. The receptacle and header assemblies 102, 104 are mated together in a direction parallel to and along the mating axis 110.

The receptacle assembly 102 includes a front housing 120 that holds a plurality of contact modules 122. Any number of contact modules 122 may be provided to increase the density of the receptacle assembly 102. The contact modules 122 each include a plurality of receptacle signal contacts 124 (shown in FIG. 2) that are received in the front housing 120 for mating with the header assembly 104. In an exemplary embodiment, each contact module 122 has a shield structure 126 for providing electrical shielding for the receptacle signal contacts 124. In an exemplary embodiment, the shield structure 126 is electrically connected to the header assembly 104 and/or the circuit board 106. For example, the shield structure 126 may be electrically connected to the header assembly 104 by extensions (e.g. beams or fingers) extending from the contact modules 122 that engage the header assembly 104. The shield structure 126 may be electrically connected to the circuit board 106 by features, such as ground pins.

The receptacle assembly 102 includes a mating end 128 and a mounting end 130. The receptacle signal contacts 124 are received in the front housing 120 and held therein at the mating end 128 for mating to the header assembly 104. The receptacle signal contacts 124 are arranged in a matrix of rows and columns. In the illustrated embodiment, at the mating end 128, the rows are oriented horizontally and the columns are oriented vertically. Other orientations are possible in alternative embodiments. Any number of receptacle signal contacts 124 may be provided in the rows and columns. The receptacle signal contacts 124 also extend to the mounting end 130 for mounting to the circuit board 106. Optionally, the mounting end 130 may be substantially perpendicular to the mating end 128.

The front housing 120 includes a plurality of signal contact openings 132 and a plurality of ground contact openings 134 at the mating end 128. The receptacle signal contacts 124 are received in corresponding signal contact openings 132. Optionally, a single receptacle signal contact 124 is received in each signal contact opening 132. The signal contact openings 132 may also receive corresponding header signal contacts 144 therein when the receptacle and header assemblies 102, 104 are mated. The ground contact openings 134 receive header shields 146 therein when the receptacle and header assemblies 102, 104 are mated. The ground contact openings 134 also receive grounding beams 302, 332, 404 (shown in FIG. 2) and grounding fingers 303, 333 (shown in FIG. 2) of the contact modules 122 that mate with the header shields 146 to electrically common the receptacle and header assemblies 102, 104.

The front housing 120 is manufactured from a dielectric material, such as a plastic material, and provides isolation between the signal contact openings 132 and the ground contact openings 134. The front housing 120 isolates the receptacle signal contacts 124 and the header signal contacts 144 from the header shields 146. The front housing 120 isolates each set of receptacle and header signal contacts 124, 144 from other sets of receptacle and header signal contacts 124, 144.

The header assembly 104 includes a header housing 138 having walls 140 defining a chamber 142. The header assembly 104 has a mating end 150 and a mounting end 152 that is mounted to the circuit board 108. Optionally, the mounting end 152 may be substantially parallel to the mating end 150. The receptacle assembly 102 is received in the chamber 142 through the mating end 150. The front housing 120 engages the walls 140 to hold the receptacle assembly 102 in the chamber 142. The header signal contacts 144 and the header shields 146 extend from a base wall 148 into the chamber 142. Additionally, the header signal contacts 144 and the header shields 146 extend through the base wall 148 and are mounted to the circuit board 108.

In an exemplary embodiment, the header signal contacts 144 are arranged as differential pairs in rows. The header shields 146 are positioned between the differential pairs to provide electrical shielding between adjacent differential pairs. In the illustrated embodiment, the header shields 146 are C-shaped and provide shielding on three sides of the pair of header signal contacts 144. The header shields 146 have a plurality of walls, such as three planar walls 154, 156, 158. The walls 154, 156, 158 may be integrally formed or alternatively, may be separate pieces. The wall 156 defines a center wall or top wall of the header shields 146. The walls 154, 158 define side walls that extend from the center wall 156.

The header shield 146 associated with another pair of header signal contacts 144 provides the shielding along the open, fourth side thereof such that each of the pairs of signal contacts 144 is shielded from each adjacent pair in the same column as well as each adjacent pair in the same row. For example, the top wall 156 of a first header shield 146 which is below a second header shield 146 provides shielding across the open bottom of the C-shaped second header shield 146. Other configurations or shapes for the header shields 146 are possible in alternative embodiments. More or less walls may be provided in alternative embodiments. The walls may be bent or angled rather than being planar. In other alternative embodiments, the header shields 146 may provide shielding for individual signal contacts 144 or sets of contacts having more than two signal contacts 144.

Figure 2:
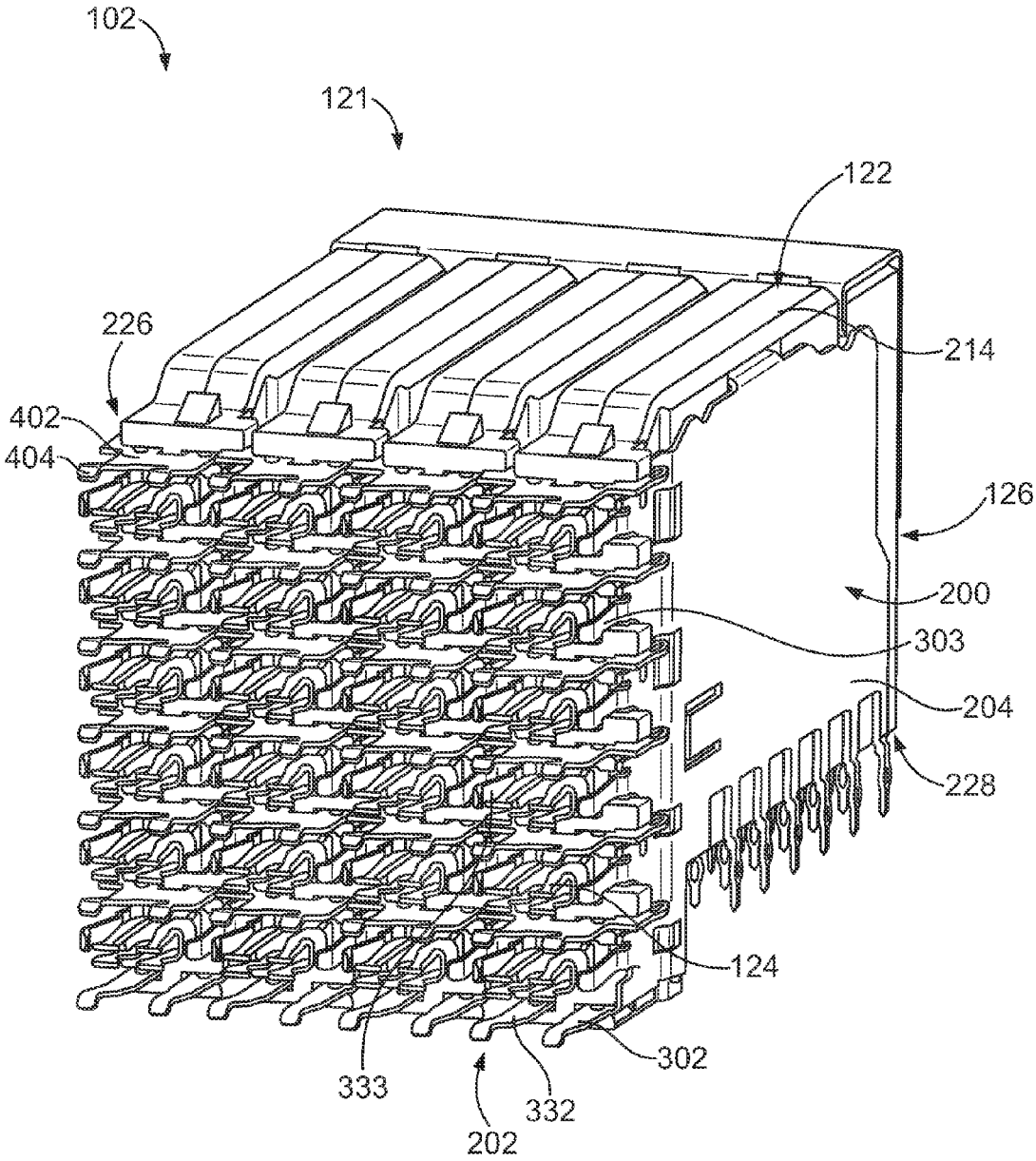
FIG. 2 is a perspective view of the receptacle assembly shown in FIG. 1 with a front housing thereof removed for clarity.

FIG. 2 is a perspective view of the receptacle assembly 102 shown in FIG. 1 with the front housing 120 thereof removed for clarity. The receptacle assembly 102 may include a stack 121 of four contact modules 122 arranged side by side from left to right. The receptacle signal contacts 124 are arranged in rows and columns. The receptacle signal contacts 124 are optionally arranged as differential pairs extending forward from the contact modules 122. Additionally, the receptacle signal contacts 124 of each contact module 122 are substantially housed within a conductive shell 214. The conductive shell 214 provides electrical shielding between rows of receptacle signal contact pairs. The conductive shell 214 defines a portion of the shield structure 126. The conductive shell 214 includes a front 226 and a bottom 228, and the receptacle signal contacts 124 extend from the conductive shell 214 at the front 226 and at the bottom 228, such as for electrical connection to the header signal contacts 144 (shown in FIG. 1) and the circuit board 106 (shown in FIG. 1), respectively.

The shield structure 126 of each contact module 122 may additionally include a right ground shield 200 and a left ground shield 202. The right ground shield 200 may include a planar main body 204 and a plurality of extensions or grounding fingers 303 extending forward therefrom to provide shielding along the right sides of the receptacle signal contacts 124. The grounding fingers 303 shield the sides of the mating portions of the receptacle signal contacts 124. In an exemplary embodiment, at the bottom of the right ground shield 200, the right ground shield 200 may optionally include a shield grounding beam 302 that shields below the bottom receptacle signal contact 124 in the corresponding column and engages the orphan ground shield of the header assembly 104. Optionally, any of the rows may include shield grounding beams 302. In an exemplary embodiment, the right ground shield 200 is manufactured from a metal material. The right ground shield 200 is a stamped and formed part with the grounding fingers 303 and grounding beam 302 being stamped and then bent during the forming process out of plane with respect to the main body 204.

Like the right ground shield 200, the left ground shield 202 includes a planar main body 205 (shown in FIG. 3) and a plurality of grounding fingers 333 extending forward therefrom to provide shielding along the left sides of the receptacle signal contacts 124. In an exemplary embodiment, at the bottom of the left ground shield 202, the left ground shield 202 includes a shield grounding beam 332 which shields below the bottom receptacle signal contact 124 in the corresponding column and engages the orphan ground shield of the header assembly 104. Optionally, any of the rows may include shield grounding beams 332. In an exemplary embodiment, the left ground shield 202 is manufactured from a metal material. The left ground shield 202 is a stamped and formed part.

The shield structure 126 of the receptacle assembly 102 additionally includes commoning clips 402 coupled to each of the contact modules 122. The commoning clips 402 are received in the stack 121 between each row of receptacle signal contacts 124, and provide shielding for the receptacle signal contacts 124, such as above and below the receptacle signal contacts 124. The commoning clips 402 extend horizontally across multiple contact modules 122, and electrically connect with each contact module 122. Therefore, unlike the ground shields 200, 202, the commoning clips 402 are not specific to each contact module 122, but are common among the contact modules 122 in the stack 121.

Each commoning clip 402 includes clip grounding beams 404 which extend forward therefrom and forward of the conductive shell 214 to shield the mating portions of the receptacle signal contacts 124. When mated with the header assembly 104 (shown in FIG. 1), the grounding fingers 303, 333, shield grounding beams 302, 332, and clip grounding beams 404 electrically connect to corresponding header shields 146 (shown in FIG. 1) to ground the connection. The shield structure 126 thus provides multiple, redundant points of contact to each header shield 146, as well as shielding on all sides of the receptacle signal contacts 124. Optionally, the receptacle assembly 102 may use another commoning clip 402 along the bottom row in lieu of using the shield grounding beams 302, 332.

Figure 3:
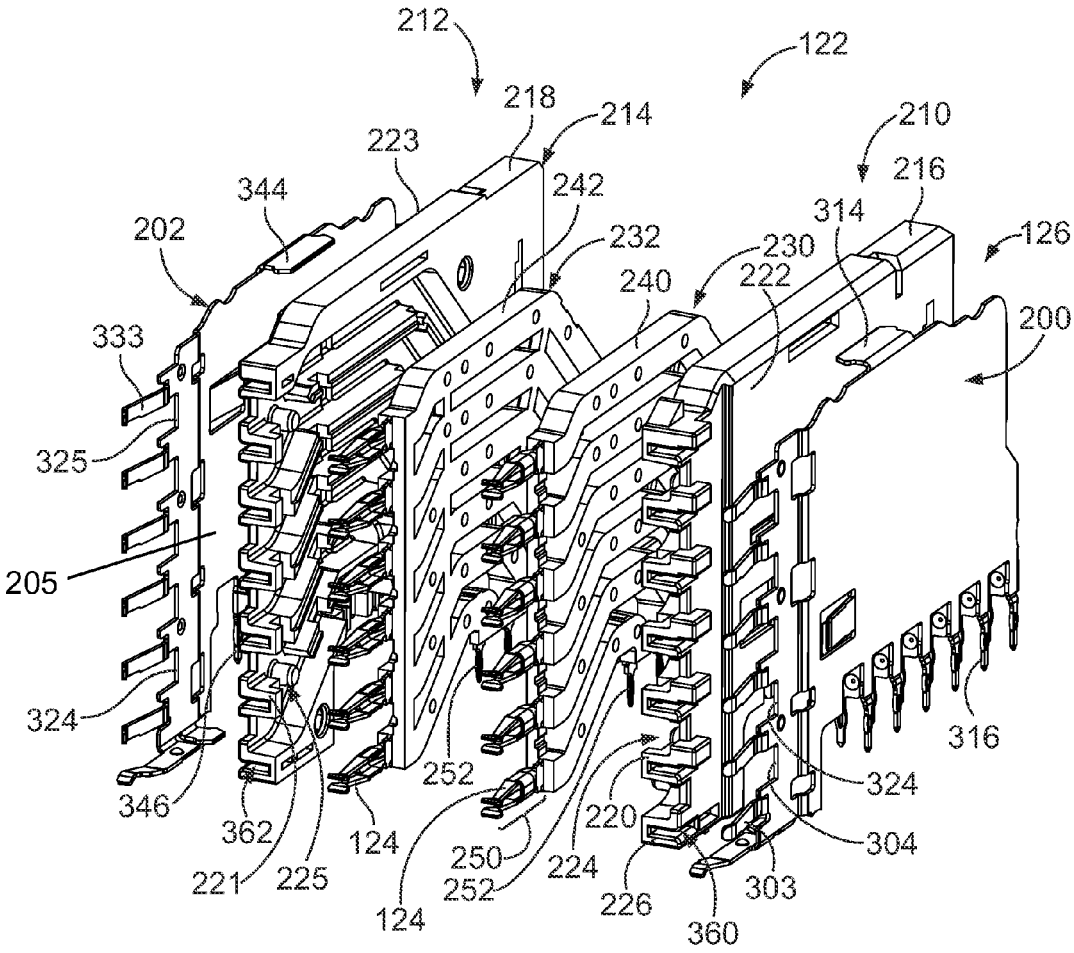
FIG. 3 is an exploded view a contact module according to an exemplary embodiment.

FIG. 3 is an exploded view of one of the contact modules 122. The contact module 122 includes a right sub-assembly 210 and a left sub-assembly 212 that are coupled together to form the contact module 122. The right and left sub-assemblies 210, 212 may be mirrored halves that are coupled together to from the contact module 122. The right and left sub-assemblies 210, 212 include right and left conductive shells 216, 218. The right and left conductive shells 216, 218 may be referred to as right and left shell members 216, 218. The shell members 216, 218 form the conductive shell 214 when assembled. The shell members 216, 218 hold respective right and left frame assemblies 230, 232, which house the receptacle signal contacts 124. The right and left sub-assemblies also include the right and left ground shields 200, 202. The ground shields 200, 202 attach to respective shell members 216, 218, and the combination defines a significant portion of the shield structure 126 of the receptacle assembly 102 (shown in FIG. 1).

The right and left shell members 216, 218 are fabricated from a conductive material. For example, the shell members 216, 218 may be die-cast from a metal material. Alternatively, the shell members 216, 218 may be stamped and formed or may be fabricated from a plastic material that has been metalized or coated with a metallic layer. By having the shell members 216, 218 fabricated from a conductive material, the shell members 216, 218 may provide electrical shielding for the receptacle assembly 102.

The right and left shell members 216, 218 include tabs 220, 221 extending inward from side walls 222, 223 thereof. The right tabs 220 define channels 224 therebetween, and the left tabs 221 define channels 225 therebetween. The receptacle signal contacts 124 of the right and left frame assemblies 230, 232 are received in corresponding channels 224, 225. The tabs 220, 221 provide shielding around the corresponding receptacle signal contacts 124.

In an exemplary embodiment, the shell members 216, 218 include grooves 360, 362 located between the channels 224, 225 at the front 226 of the conductive shell 214. The grooves 360, 362 are configured to receive portions of the commoning clips 402 (shown in FIG. 2) to mechanically and electrically connect the commoning clips 402 to the shell members 216, 218.

The right and left frame assemblies 230, 232 each include a dielectric frame 240, 242 that surrounds the respective receptacle signal contacts 124. In an exemplary embodiment, the receptacle signal contacts 124 are initially held together as lead frames (not shown), which are overmolded with dielectric material to form the dielectric frames 240, 242. Other manufacturing processes may be utilized to form the contact modules 122 other than overmolding a lead frame, such as loading receptacle signal contacts 124 into a formed dielectric body.

The receptacle signal contacts 124 have mating portions 250 extending from the front of the dielectric frames 240, 242 and contact tails 252 extending from the bottom of the dielectric frames 240, 242. Other configurations are possible in alternative embodiments. The mating portions 250 and contact tails 252 are the portions of the receptacle signal contacts 124 that are configured to be coupled to the header signal contacts 144 (shown in FIG. 1) and the circuit board 106 (shown in FIG. 1), respectively. In an exemplary embodiment, the mating portions 250 extend generally perpendicular with respect to the contact tails 252. Inner portions or encased portions of the receptacle signal contacts 124 transition between the mating portions 250 and the contact tails 252 within the dielectric frames 240, 242.

During assembly of the right sub-assembly 210, the right frame assembly 230, including the dielectric frame 240 and corresponding receptacle signal contacts 124, is coupled to the right shell member 216. For example, the right frame assembly 230 is received in corresponding channels 224 of the right shell member 216. The right tabs 220 extend through the right frame assembly 230 such that the tabs 220 are positioned between adjacent receptacle signal contacts 124. The right ground shield 200 is coupled to the right shell member 216, such as using mounting tabs 314. In a similar manner, to assemble the left sub-assembly 212, the left frame assembly 232 is coupled to the left shell member 218 with the left tabs 221 extending through the left frame assembly 232 to provide shielding between the receptacle signal contacts 124. The left ground shield 202 is coupled to the left shell member 218, such as using mounting tabs 344. The right and left sub assemblies 210, 212 are coupled together, such as by pressing dowels or pins into openings to hold the shell members 216, 218 together. The communing clips 402 (shown in FIG. 2) may be used to additionally hold the shell members 216, 218 together.

The shell members 216, 218, which are part of the shield structure 126, provide electrical shielding between and around respective receptacle signal contacts 124. The shell members 216, 218 provide shielding from electromagnetic interference (EMI) and/or radio frequency interference (RFI). The shell members 216, 218 may provide shielding from other types of interference as well. The shell members 216, 218 provide shielding around the outside of the frames 240, 242, and thus around the outside of all of the receptacle signal contacts 124, such as between pairs of receptacle signal contacts 124, as well as between adjacent pairs of the receptacle signal contacts 124 using the tabs 220, 221 to control electrical characteristics, such as impedance control, cross-talk control, and the like, of the receptacle signal contacts 124.

In an exemplary embodiment, the grounding fingers 303 are vertically spaced from each other along the front 304 of the ground shield 200. The grounding fingers 303 may extend along the sides of the receptacle signal contacts 124. The grounding fingers 303 may provide shielding between the receptacle signal contacts 124 and receptacle signal contacts 124 of an adjacent contact module 122 held in the receptacle assembly 102. The grounding fingers 303 may be generally vertically aligned with receptacle signal contacts 124 in a corresponding row of the receptacle signal contacts 124. Alternatively, the grounding fingers 303 may be vertically offset, such as below, the receptacle signal contacts 124. In an exemplary embodiment, adjacent each grounding finger 303 is a landing pad 324 along the exterior side of the right ground shield 200. When the commoning clip 402 (shown in FIG. 2) is coupled to the contact module 122, the commoning clip 402 engages the landing pad 324 to electrically connect the commoning clip 402 to the right ground shield 200.

The right ground shield 200 includes a plurality of ground pins 316 extending from the bottom of the right ground shield 200. The ground pins 316 are configured to be terminated to the circuit board 106 (shown in FIG. 1). The ground pins 316 may be compliant pins, such as eye-of-the-needle pins, that are through-hole mounted to plated vias in the circuit board 106. Other types of termination means or features may be provided in alternative embodiments to couple the right ground shield 200 to the circuit board 106.

The left ground shield 202 may be similar to the right ground shield 200. The grounding fingers 333 are vertically spaced from each other along the front 334 of the left ground shield 202. The grounding fingers 333 may extend along the sides of the receptacle signal contacts 124. The grounding fingers 333 may provide shielding between the receptacle signal contacts 124 and receptacle signal contacts 124 of an adjacent contact module 122 held in the receptacle assembly 102. The grounding fingers 333 may be generally vertically aligned with receptacle signal contacts 124 in a corresponding row of the receptacle signal contacts 124. Alternatively, the grounding fingers 333 may be vertically offset, such as below, the receptacle signal contacts 124. In an exemplary embodiment, adjacent each grounding finger 333 is a landing pad 325 along the exterior side of the left ground shield 202. When the commoning clip 402 (shown in FIG. 2) is coupled to the contact module 122, the commoning clip 402 engages the landing pad 325 to electrically connect the commoning clip 402 to the left ground shield 202.

The left ground shield 202 includes a plurality of ground pins 346 extending from the bottom of the left ground shield 202. The ground pins 346 are configured to be terminated to the circuit board 106 (shown in FIG. 1). The ground pins 346 may be compliant pins, such as eye-of-the-needle pins, that are through-hole mounted to plated vias in the circuit board 106. Other types of termination means or features may be provided in alternative embodiments to couple the left ground shield 202 to the circuit board 106.

Figure 4:
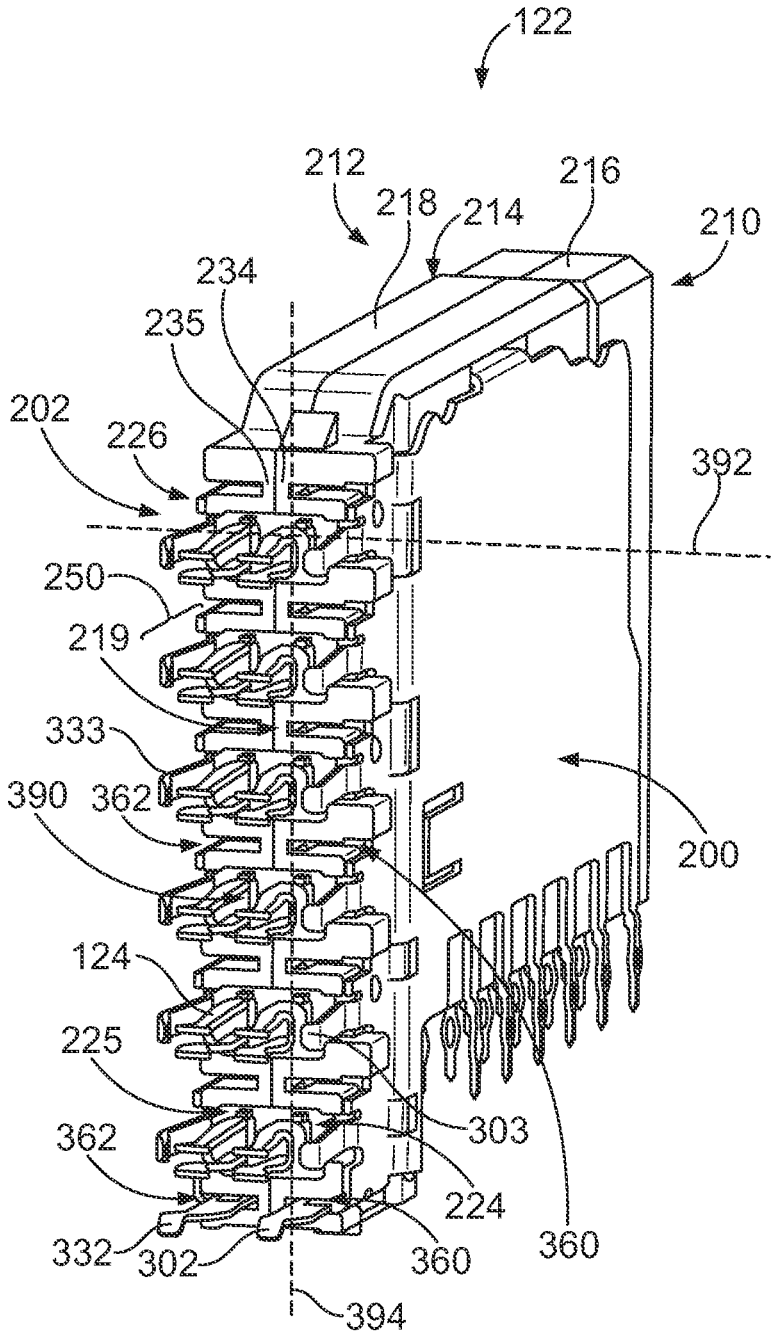
FIG. 4 is an assembled perspective view of the contact module in FIG. 3.

FIG. 4 is an assembled perspective view of the contact module 122 shown in FIG. 3. During assembly of the contact module 122, the dielectric frames 240, 242 (shown in FIG. 3) are received in the corresponding shell members 216, 218. The shell members 216, 218 are coupled together and generally surround the dielectric frames 240, 242. Right interior walls 234 of the right shell member 216 align with left interior walls 235 of the left shell member 216 at the front of the conductive shell 214 at multiple interfaces that define a seam 219. The seam 219 extends vertically at the interface between the right and left sub-assemblies 210, 212.

The dielectric frames 240, 242 are aligned adjacent one another such that the receptacle signal contacts 124 are aligned with one another and define contact pairs 390. Each contact pair 390 is received in corresponding channels 224, 225 of the shell members 216, 218. Each contact pair 390 is configured to transmit differential signals through the contact module 122. The receptacle signal contacts 124 within each contact pair 390 are arranged in rows that extend along row axes 392. The receptacle signal contacts 124 within each dielectric frame 240, 242 are arranged in columns along column axes 394.

The right and left ground shields 200, 202 are coupled to the conductive shell 214 to provide additional shielding for the receptacle signal contacts 124. When assembled, the right ground shield 200 is positioned exterior of, and along, the right shell member 216. Likewise, the left ground shield 202 is positioned exterior of, and along, the left shell member 218. In an exemplary embodiment, the shield grounding beams 302, 332 extend into the lower row of grooves 360, 362 and are generally aligned with the receptacle contact mating portions 250 along the column axes 394. The grounding fingers 303, 333 extend forward from the front 226 of the conductive shell 214. The grounding fingers 303, 333 are generally aligned with the mating portions 250 along the row axes 392. The right and left ground shields 200, 202 are configured to be electrically connected to the header shields 146 (shown in FIG. 1) when the receptacle assembly 102 is coupled to the header assembly 104 (both shown in FIG. 1).

Figure 5:
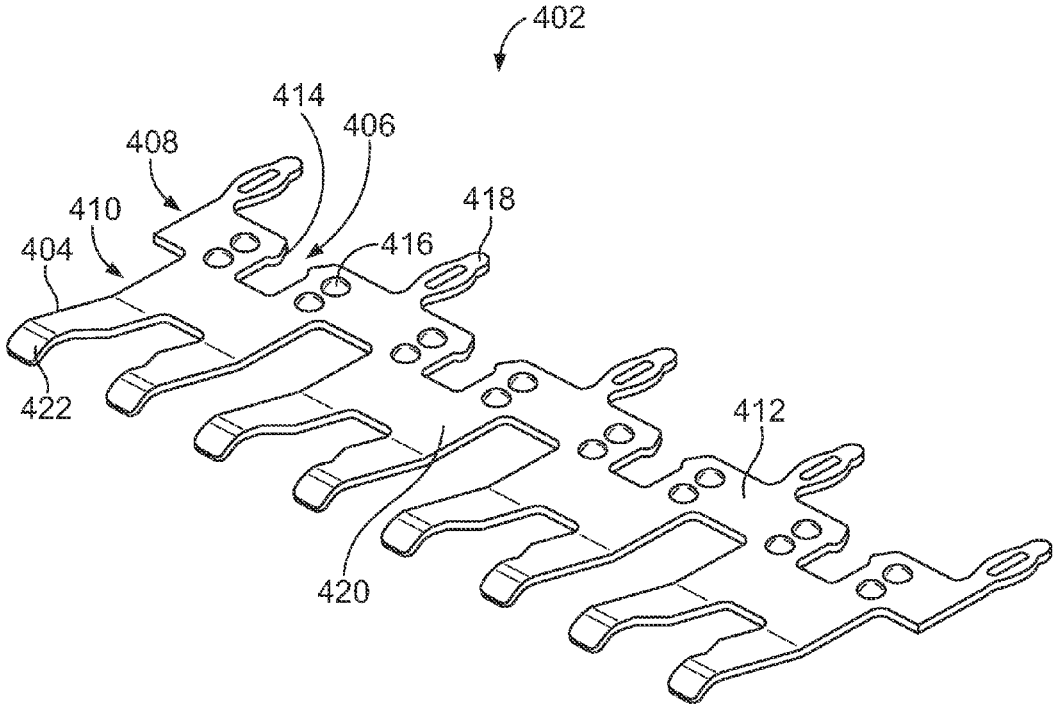
FIG. 5 is a perspective view of a commoning clip shown in FIG. 2.

FIG. 5 is a perspective view of the commoning clip 402. In an exemplary embodiment, the commoning clip 402 couples to multiple contact modules 122 (shown in FIG. 4) to mechanically and electrically couple the contact modules 122 together. The commoning clip 402 includes openings 406 located along a rear 408 thereof for coupling to the conductive shells 214 (shown in FIG. 4) of each contact module 122. The clip grounding beams 404 extend forward from a front 410 of the commoning clip 402 for electrical connection to header shields 146 (shown in FIG. 1) of the header assembly 104 (shown in FIG. 1). In an exemplary embodiment, multiple commoning clips 402 are used to provide shielding and electrically connect the contact modules 122.

The commoning clip 402 is fabricated from a conductive material. For example, the commoning clip 402 may be stamped and formed from a metal sheet. The commoning clip 402 has a generally planar main body 412. The clip grounding beams 404 may be stamped and then bent during the forming process out of plane with respect to the main body 412. By having the commoning clip 402 fabricated from a conductive material, the commoning clip 402 may provide electrical shielding for the receptacle assembly 102 (shown in FIG. 1). In addition, the commoning clip 402 is formed as one piece, so the electrical connections between the header shields 146 and the clip grounding beams 404 are commoned across all contact modules 122.

The rear 408 of the commoning clip 402 couples to the contact modules 122. The openings 406 are spaced along the length of the commoning clip 402. The openings 406 include barbs 414 along sides of the openings 406 that extend into the openings 406. The barbs 414 face each other across the opening 406. The barbs 414 reduce the width of the opening 406 and are used to provide an interference fit when coupled to the contact modules 122. The rear 408 of the commoning clip 402 may include dimples 416 which extend above and/or below the plane of the main body 412. The dimples 416 may be located near the openings 406.

In an exemplary embodiment, the commoning clip 402 includes shield fingers 418 extending from the rear 408 thereof. The shield fingers 418 may be compliant pins, such as eye-of-the-needle pins, and will be referred to hereinafter as pins 418. The pins 418 are horizontally spaced along the length of the commoning clip 402. The pins 418 may be generally coplanar with the main body 412. In an exemplary embodiment, the pins 418 are positioned between adjacent openings 406 in specified locations such that when the commoning clip 402 is loaded into the contact modules 122, each pin 418 engages right and left ground shields 200, 202 of adjacent contact modules 122 (shown in FIG. 6). The pins 418 may engage the ground shields 200, 202 by an interference fit.

The commoning clip 402 includes a jumper region 420 between openings 406 at the rear 408 and the clip grounding beams 404 at the front 410. The jumper region 420 physically connects the regions of the commoning clip 402 together. The jumper region 420 electrically connects and commons the grounding beams 404 and pins 418 together.

The clip grounding beams 404 each have a mating interface 422 at a distal end thereof. The mating interface 422 is configured to engage the corresponding header shield 146 (shown in FIG. 1).

Figure 6:
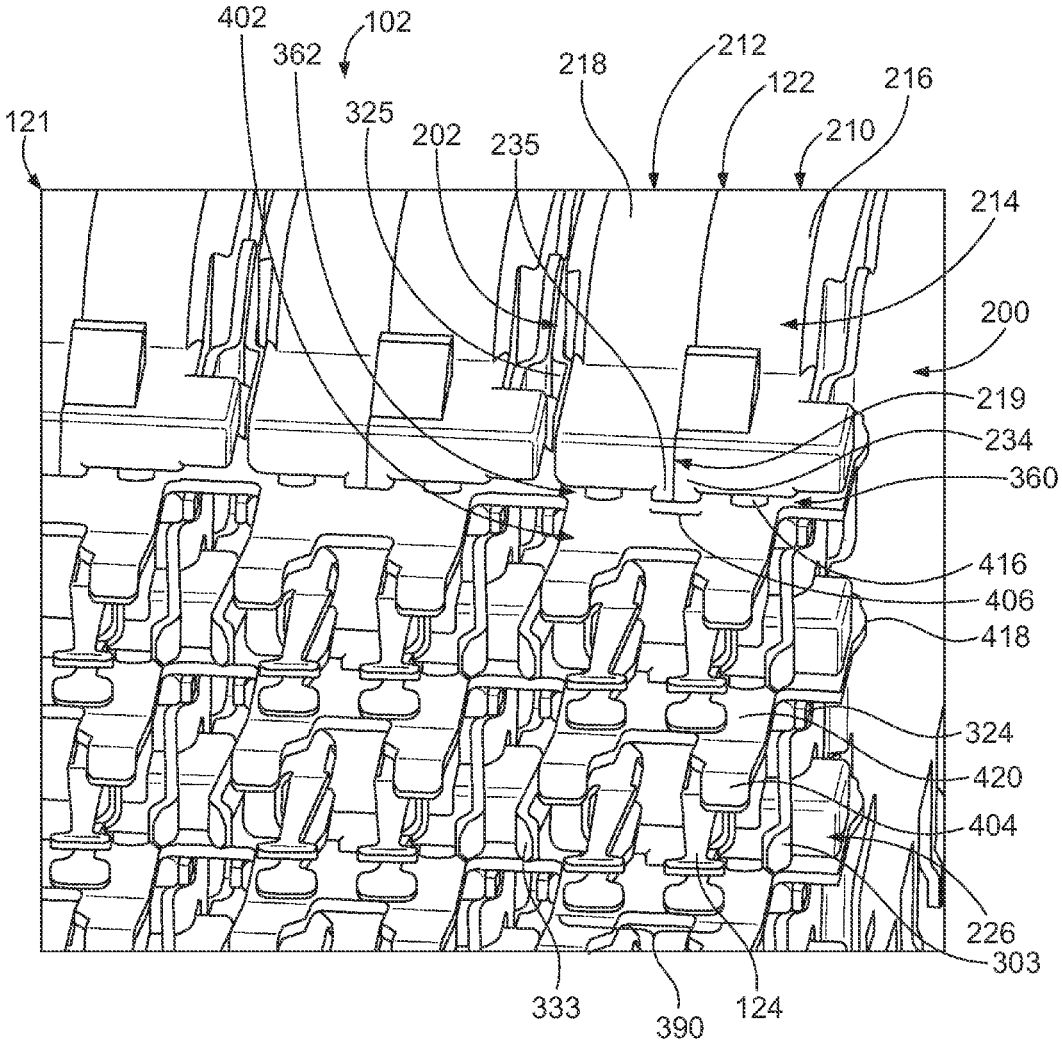
FIG. 6 is an enlarged view of a top corner portion of the receptacle assembly shown in FIG. 2.

FIG. 6 is an enlarged view of a top corner portion of the receptacle assembly 102 with the housing 120 (shown in FIG. 1) removed. The commoning clips 402 are shown loaded into the stack 121 of contact modules 122. In an exemplary embodiment, the commoning clip 402 extends horizontally across all of the contact modules 122 in the receptacle assembly 102. In an alternative embodiment, commoning clips that extend across only one contact module 122 may be used, such as to electrically connect the shell members 216, 218 together.

During assembly, the commoning clip 402 is inserted into the grooves 360, 362 of the shell members 216, 218 until the commoning clip 402 contacts the interior walls 234, 235 of the shell members 216, 218. Upon insertion, the dimples 416 are loaded into the grooves 360, 362 and engage inner walls of the grooves 360, 362 to create an interference fit between the communing clip 402 and the shell members 216, 218. The dimples 416 stabilize the commoning clip 402 and prohibit unintentional disengagement of the commoning clip 402 from the contact modules 122. Electrical connections are defined between the communing clip 402 at the dimples 416 and each of the shell members 216, 218. The interior walls 234, 235 of the shell members 216, 218 are received in corresponding openings 406. The interior walls 234, 235 are pinched together at the seam 219 by the barbs 414 (shown in FIG. 5). The interior walls 234, 235 enter the openings 406 and the barbs 414 engage the interior walls 234, 235 by an interference fit. The barbs 414 force the interior wall 234 towards the interior wall 235 and vice-versa, pinching the interior walls 234, 235 together at the seam 219. The openings 406 and barbs 414 hold the right and left sub-assemblies 210, 212 of each contact module 122 together.

When assembled, the pins 418 extend between the right ground shield 200 of one contact module 122 and the left ground shield 202 of the adjacent contact module 122. The pins 418 engage corresponding landing pads 324, 325 of the ground shields 200, 202. The compliant design of the pins 418 pushes the ground shields 200, 202 against the shell members 216, 218, helping to squeeze the shell members 216, 218 together. Electrical connections are defined between the commoning clip 402 at the pins 418, and each of the ground shields 200, 202. The eye-of-the-needle design applies a force to the ground shields 200, 202 towards the respective conductive shell members 216, 218. More specifically, the pin 418 will push the right ground shield 200 of one contact module 122 toward the corresponding right shell member 216, while simultaneously pushing the left ground shield 202 of the adjacent contact module 122 toward the corresponding left shell member 218. The pins 418 thus force the ground shields 200, 202 against the shell members 216, 218 to hold the conductive shells 214 together and to force the ground shields 200, 202 into direct electrical contact with the conductive shell 214.

The jumper regions 420 are positioned forward of, and extend across, the front 226 of the shell members 216, 218. In an exemplary embodiment, the jumper regions 420 and grounding beams 404 extend vertically above and/or below the signal contact pairs 390. The grounding beams 404 are generally aligned, in column, with corresponding receptacle signal contacts 124 of the receptacle signal contact pairs 390.

In an exemplary embodiment, multiple commoning clips 402 are attached to the stack 121. Each commoning clip 402 is vertically spaced from the other commoning clips 402 such that there is a commoning clip 402 above and below each row of receptacle contact signals 124. Therefore, each contact pair 390 will be shielded above and below by corresponding clip grounding beams 404. In addition, right and left grounding fingers 303, 333 of the right and left ground shields 200, 202 shield each contact pair 390 on the sides. As a result, each contact pair 390 is substantially shielded on all four sides to reduce electrical interference in the signal connection. Optionally, the right and left ground shields 200, 202 and the communing clips 402 provide shielding between the contact pairs 390 even when the receptacle assembly 102 is partially unmated or not fully mated with the header assembly 104.

Figure 7:
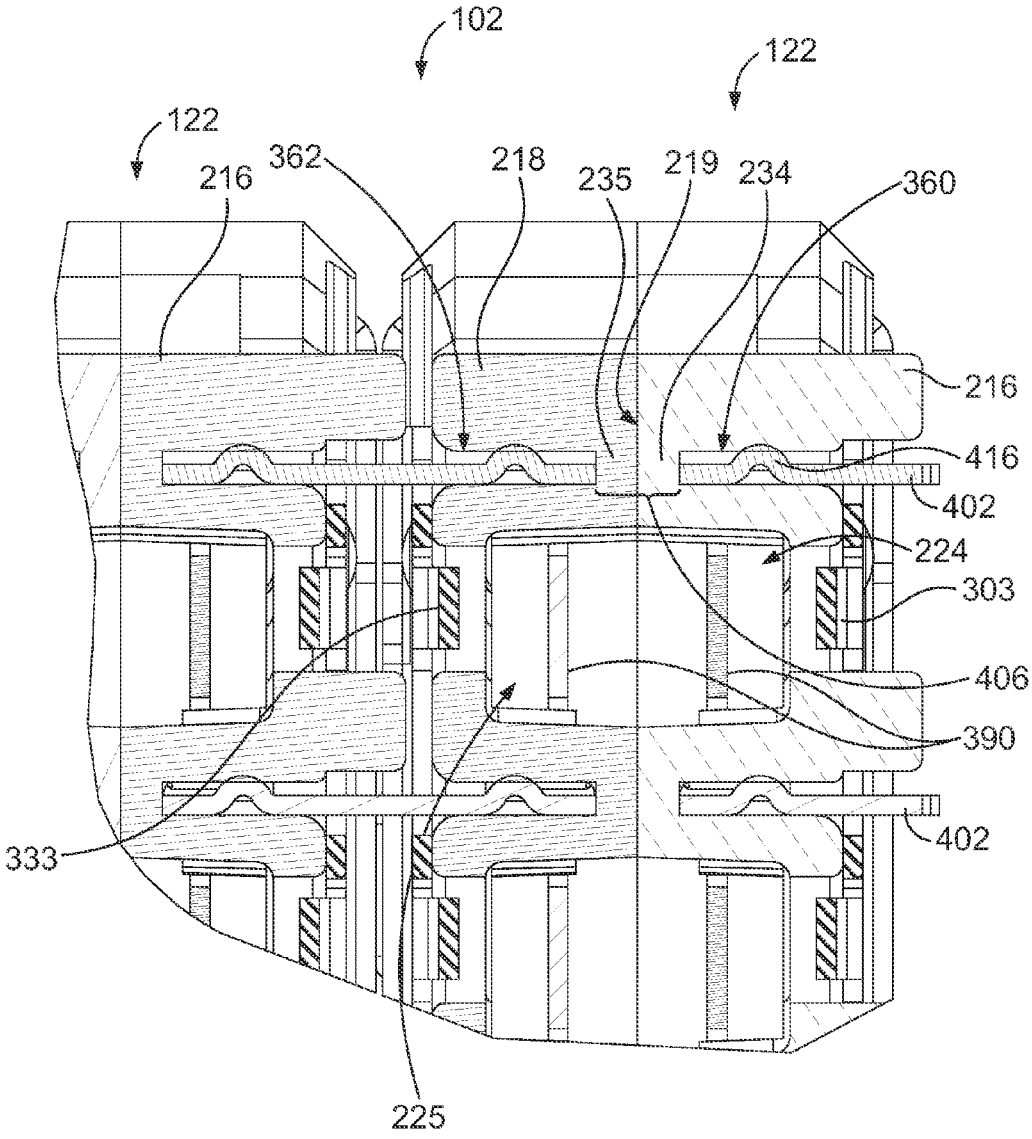
FIG. 7 is a cross-sectional view of the receptacle assembly shown in FIG. 6.

FIG. 7 is a cross-sectional view of a portion of the receptacle assembly 102. As shown, when the commoning clips 402 are coupled to the contact modules 122, the commoning clips 402 enter the grooves 360, 362 of the shell members 216, 218. The interior walls 234, 235 of the shell members 216, 218 are received in the openings 406. The openings 406 are sized such that the interior walls 234, 235 are forced against each other at the seam 219 in order to fit within the openings 406. Further, the barbs 414 (shown in FIG. 5) along the inner walls of the openings 406 provide additional points of contact with the interior walls 234, 235 and provide additional force on the interior walls 234, 235 towards each other.

The dimples 416 on the commoning clip 402 engage the inner walls of the grooves 360, 362. In an exemplary embodiment, the dimples 416 engage the inner walls of the grooves 360, 362 by an interference fit which stabilizes the communing clip 402 relative to the contact modules 122 and prohibits unintentional removal therefrom. The receptacle signal contact pairs 390 are housed in the channels 224, 225 of the right and left shell members 216, 218. Along the outer side of the shell members 216, 218 are the ground fingers 303, 333.

Figure 8:
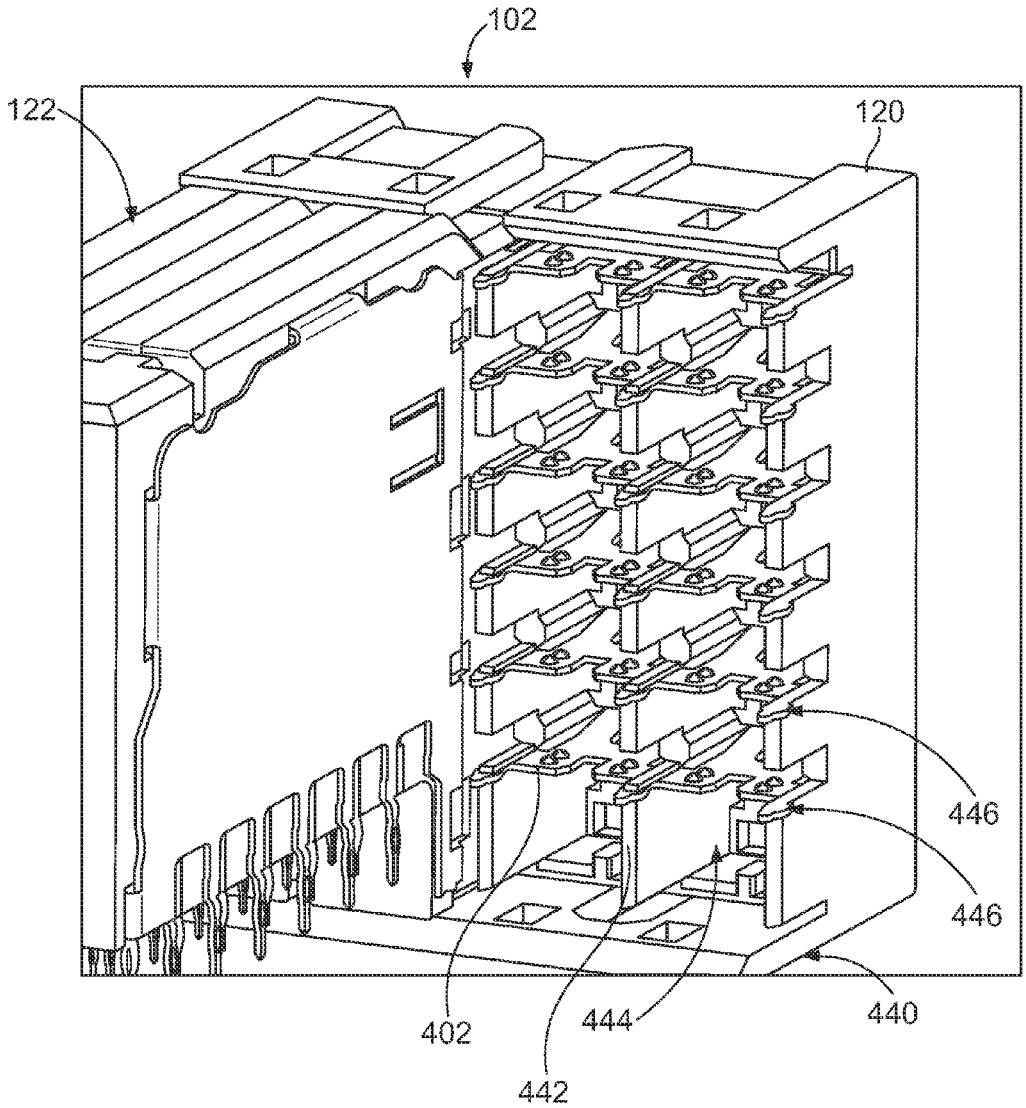
FIG. 8 is a rear perspective view of the receptacle assembly shown in FIG. 1 with two contact modules thereof removed for clarity.

FIG. 8 is a rear perspective view of a portion of the receptacle assembly 102 with two contact modules 122 thereof removed for clarity. The front housing 120 includes a rear side 440 configured to receive the contact modules 122 therein. The rear side 440 includes multiple vertical ribs 442. The vertical ribs 442 are spaced from each other and define multiple cavities 444 therebetween that are configured to receive individual contact modules 122. The vertical ribs 442 include multiple slots 446 that hold the communing clips 402 within the front housing 120.

In an exemplary embodiment, the commoning clips 402 are coupled to each of the contact modules 122 prior to loading the commoning clips 402 and contact modules 122 into the front housing 120. Alternatively, the commoning clips 402 may be first loaded individually into the slots 446 of the front housing 120. Then, the contact modules 122 may be loaded individually into the cavities 444, where upon doing so the contact modules 122 engage the preloaded commoning clips 402.

When assembled, the clip grounding beams 404 (shown in FIG. 5) extend into the ground contact openings 134 (shown in FIG. 1) in the front housing 120 for mating with the header shields 146 (shown in FIG. 1) of the header assembly 104 (shown in FIG. 1).

Figure 9:
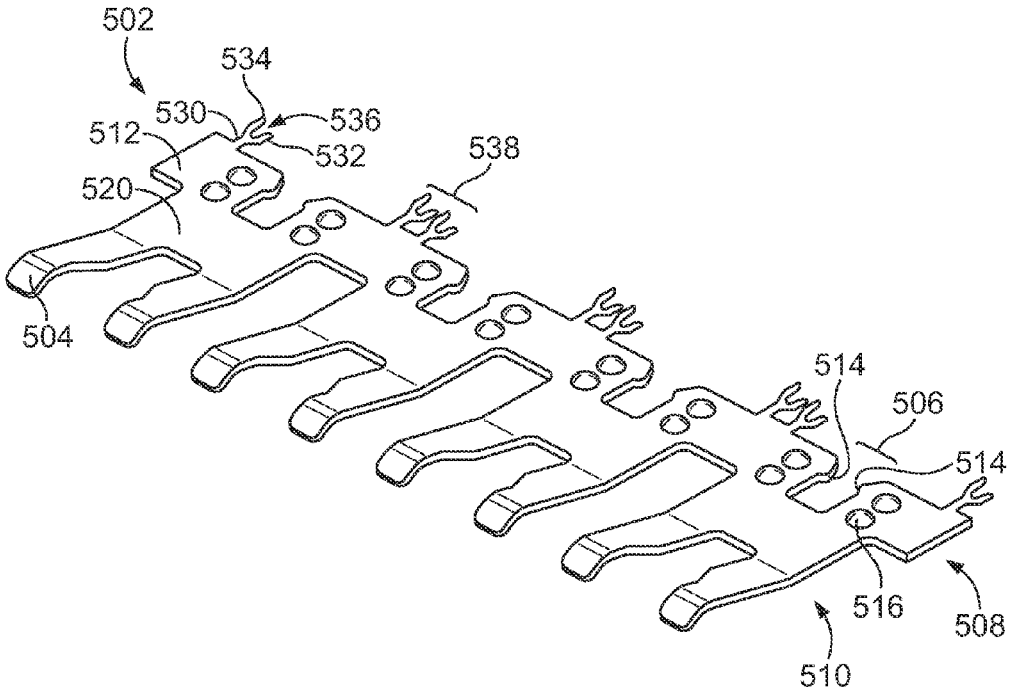
FIG. 9 is a perspective view of a commoning clip formed in accordance with an exemplary embodiment.

FIG. 9 is a perspective view of a commoning clip 502 formed in accordance with an exemplary embodiment. The commoning clip 502 may be similar to the commoning clip 402 (shown in FIGS. 2 and 5-8) in some respects. The commoning clip 502 includes a main body 512 with a rear 508 and a front 510. The front 510 of the commoning clip 502 includes a jumper region 520 and clip grounding beams 504 extending forward therefrom. The rear 508 of the main body 512 defines openings 506, and barbs 514 extend into the openings 506. Dimples 516 extend above and/or below the plane of the main body 512.

The commoning clip 502 also includes a plurality of shield fingers 530 extending from the rear 508 thereof. The shield fingers 530 may be shaped like tuning forks, and will be referred to hereinafter as tuning fork contacts 530. The tuning fork contacts 530 may be generally planar with the main body 512. Each tuning fork contact 530 includes a right tine 532 and a left tine 534. The right and left tines 532, 534 define a slot 536 therebetween. In an exemplary embodiment, the tuning fork contacts 530 are mounted in pairs 538 between the openings 506 and aligned such that one tuning fork contact 530 receives and engages the right ground shield 200 (shown in FIG. 2) of one contact module 122 (shown in FIG. 2), and the other tuning fork contact 530 in the pair 538 receives and engages the left ground shield 202 (shown in FIG. 2) of the adjacent contact module 122. Each tuning fork contact 530 receives the front 304, 334 of a respective ground shield 200, 202 within the slot 536. In an exemplary embodiment, the ground shields 200, 202 are held by an interference fit within the slots 536 of the tuning fork contacts 530.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A receptacle assembly comprising:

a front housing configured for mating with a header assembly;

a plurality of contact modules coupled to the front housing, the contact modules each including a right sub-assembly and a left sub-assembly, the right sub-assembly comprising a right conductive shell holding a frame assembly, the frame assembly having a plurality of contacts and a dielectric frame supporting the contacts, the dielectric frame being received in the right conductive shell, the contacts extending from the right conductive shell for electrical termination, the left sub-assembly comprising a left conductive shell holding a frame assembly, the frame assembly having a plurality of contacts and a dielectric frame supporting the contacts, the dielectric frame being received in the left conductive shell, the contacts extending from the left conductive shell for electrical termination; and a commoning clip coupled to the plurality of contact modules, the commoning clip having grounding beams extending from a front thereof, the grounding beams extending forward of the right and left conductive shells for electrical connection to header shields of the header assembly, the commoning clip including a plurality of openings in a rear thereof, each opening receiving right and left conductive shells of a corresponding contact module, the commoning clip engaging the right and left conductive shells in the openings to electrically connect the commoning clip to both the right and left conductive shells of each contact module.

2. The receptacle assembly of claim 1, wherein the commoning clip pinches the right and left conductive shells against each other to hold the right and left conductive shells in electrical connection with each other.

3. The receptacle assembly of claim 1, wherein the commoning clip includes barbs along the sides of the openings, the barbs engaging the right and left conductive shells by an interference fit.

4. The receptacle assembly of claim 1, wherein the right conductive shell includes a groove, the left conductive shell includes a groove, the commoning clip being received in the grooves of the right and left conductive shells and being held in the grooves by an interference fit.

5. The receptacle assembly of claim 4, wherein the commoning clip further comprises dimples, the dimples engaging the right and left conductive shells in the grooves.

6. The receptacle assembly of claim 1, wherein the commoning clip holds the positions of the contact modules with regards to the other contact modules.

7. The receptacle assembly of claim 1, wherein the commoning clip includes a stamped and formed body, the commoning clip being generally planar and extending across each of the contact modules.

8. The receptacle assembly of claim 1, wherein the right and left conductive shells meet at a seam, the commoning clip spanning across the seam and pressing the right and left conductive shells together at the seam.

9. The receptacle assembly of claim 1, wherein each contact module further comprises a right shield coupled to the right conductive shell and a left shield coupled to the left conductive shell, the right and left shields including grounding fingers electrically connected to the header shields, the commoning clip being directly electrically connected to the right and left shields of each contact module.

10. The receptacle assembly of claim 9, wherein the commoning clip includes shield fingers extending from the rear thereof, the shield fingers engaging corresponding right and left shields.

11. The receptacle assembly of claim 9, wherein the commoning clip includes shield fingers extending from the rear thereof, the shield fingers engaging the right shield of one contact module and the left shield of a different contact module.

12. The receptacle assembly of claim 1, wherein the commoning clip is loaded into the front housing, the contact module being loaded into the front housing to engage the commoning clip.

13. The receptacle assembly of claim 1, further comprising a plurality of commoning clips coupled to each of the contact modules, the commoning clips being parallel to each other.

14. A receptacle assembly comprising:

a front housing configured for mating with a header assembly;

a plurality of contact modules coupled to the front housing, the contact modules each including a right sub-assembly and a left sub-assembly, the right sub-assembly comprising a right conductive shell holding a frame assembly, the frame assembly having a plurality of contacts and a dielectric frame supporting the contacts, the dielectric frame being received in the right shell, the contacts extending from the right shell for electrical termination, the left sub-assembly comprising a left conductive shell holding a frame assembly, the frame assembly having a plurality of contacts and a dielectric frame supporting the contacts, the dielectric frame being received in the left shell, the contacts extending from the left shell for electrical termination;

a right ground shield coupled to the right conductive shell, the right ground shield having grounding fingers extending from a front of the right ground shield, the grounding fingers extending forward of the front of the right ground shield for electrical connection to header shields of the header assembly;

a left ground shield coupled to the left conductive shell, the left ground shield having grounding fingers extending from a front of the left ground shield, the grounding fingers extending forward of the front of the left ground shield for electrical connection to the header shields of the header assembly; and a commoning clip coupled to the plurality of contact modules, the commoning clip having grounding beams extending from a front thereof, the grounding beams extending forward of the right and left conductive shells for electrical connection to the header shields of the header assembly, the commoning clip being directly electrically connected to the right and left conductive shells of each contact module to electrically connect the commoning clip to each contact module, the commoning clip being directly electrically connected to the right and left ground shields of each contact module to electrically connect the commoning clip to each contact module.

15. The receptacle assembly of claim 14, wherein the commoning clip includes a plurality of openings in a rear thereof with barbs along sides of the openings, each opening receiving right and left conductive shells of a corresponding contact module with the barbs engaging the right and left conductive shells to electrically connect the commoning clip to both the right and left conductive shells of each contact module.

16. The receptacle assembly of claim 14, wherein the commoning clip pinches the right and left conductive shells against each other to hold the right and left conductive shells in electrical connection with each other.

17. The receptacle assembly of claim 14, wherein the right conductive shell includes a groove, the left conductive shell includes a groove, the commoning clip being received in the grooves of the right and left conductive shells and being held in the grooves by an interference fit.

18. The receptacle assembly of claim 17, wherein the commoning clip further comprises dimples, the dimples engaging the right and left conductive shells in the grooves.

19. The receptacle assembly of claim 14, wherein the commoning clip includes shield fingers extending from the rear thereof, the shield fingers engaging corresponding right and left ground shields of each contact module to electrically connect the commoning clip to each contact module.

20. The receptacle assembly of claim 14, wherein the right and left conductive shells meet at a seam, the commoning clip spanning across the seam and pressing the right and left conductive shells together at the seam.

* * * * *